United States Patent [19]

Olds

[11] 4,043,762

[45] Aug. 23, 1977

[54] COUPLING MEANS FOR TEST TUBES AND THE LIKE

[76] Inventor: George Milton Olds, 3401 Glasgow Drive, Lansing, Mich. 48910

[21] Appl. No.: 729,964

[22] Filed: Oct. 6, 1976

[51] Int. Cl.[2] ..... B01L 9/06; B01L 9/00; B01L 3/14; B65D 37/00

[52] U.S. Cl. ..... 23/292; 73/374; 248/318; 215/1 C; 215/100 R; 150/.5

[58] Field of Search .....23/292, 259; 64/11 F, 64/11 R; 248/204, 309, 311.1, 312, 314, 318, 359; 73/374; 428/35; 215/1 C, 100 R, 100 A; 206/806, 423; 150/.5

[56] References Cited

U.S. PATENT DOCUMENTS

| | | | |
|---|---|---|---|
| 1,600,931 | 9/1926 | Chatman | 248/318 |
| 2,448,563 | 9/1948 | Wetzel | 248/318 X |
| 2,982,434 | 5/1961 | Hidding | 215/100 A |
| 3,202,324 | 8/1965 | Honnet et al. | 215/100 R UX |
| 3,288,318 | 11/1966 | Corbin et al. | 215/1 C X |
| 3,482,677 | 12/1969 | Small | 150/.5 X |
| 3,807,679 | 4/1974 | Burke et al. | 248/318 X |
| 3,813,223 | 5/1974 | Fleck | 23/292 X |
| 3,878,695 | 4/1975 | Pitner | 64/11 R |

*Primary Examiner*—Morris O. Wolk
*Assistant Examiner*—Roger F. Phillips
*Attorney, Agent, or Firm*—Malcolm R. McKinnon

[57] ABSTRACT

Coupling means for test tubes and the like, the coupling means enabling the coupling of test tubes to other objects or devices for various purposes, as for example, support purposes. In one embodiment of the invention, the coupling means is comprised of a flexible, resilient, tubular body portion which is open at each end and which is adapted to be slidably circumposed on a portion of the periphery of a conventional tubular test tube of the type that is closed at one end, the coupling means also including a pair of circumferentially spaced, flexible, resilient and integral flange portions which project longitudinally outwardly from one end of the tubular body portion and which define openings adjacent the free ends thereof adapted to receive a cooperating member such as the stem of a conventional funnel, a support rod, a thermometer or other object to which it is desired to couple a test tube. In another embodiment of the invention, the coupling means is formed integrally with the body portion of a test tube.

18 Claims, 11 Drawing Figures

Fig. 1.
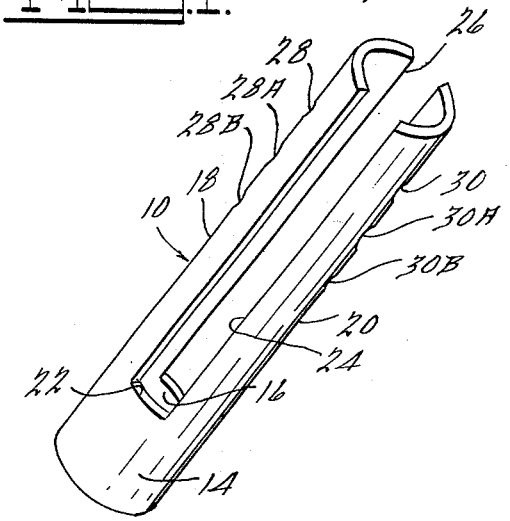
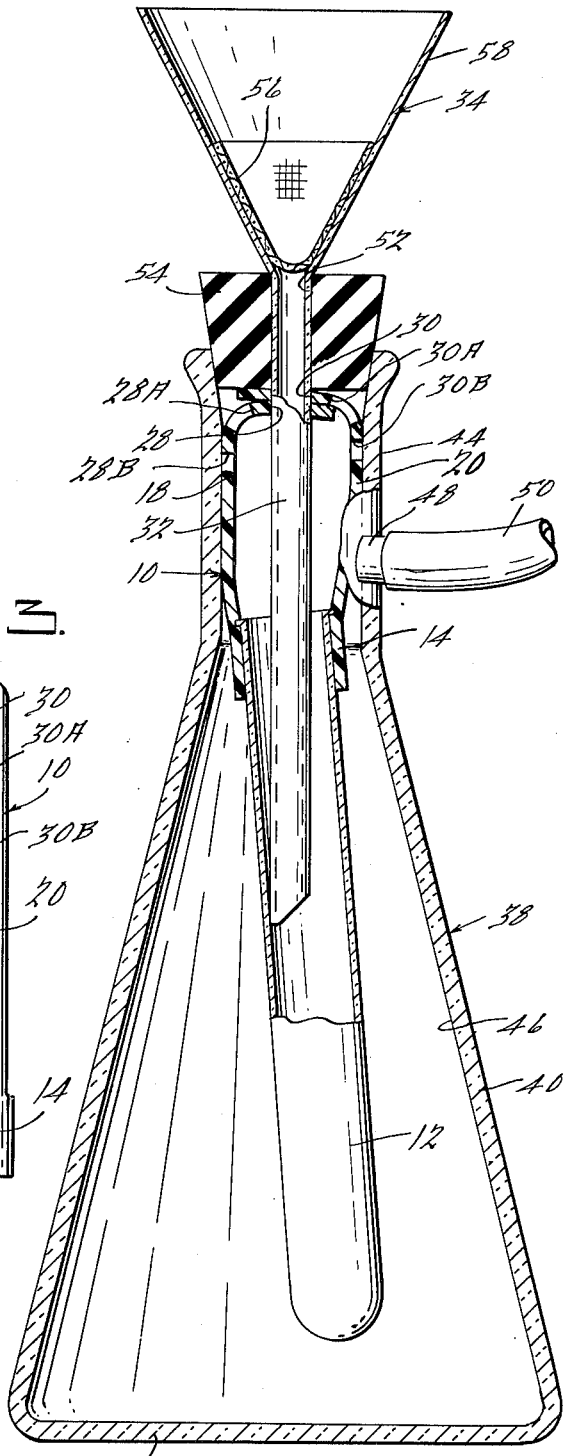
Fig. 3.
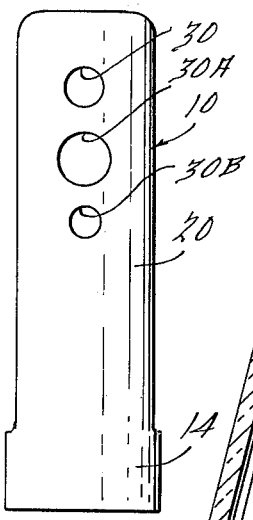
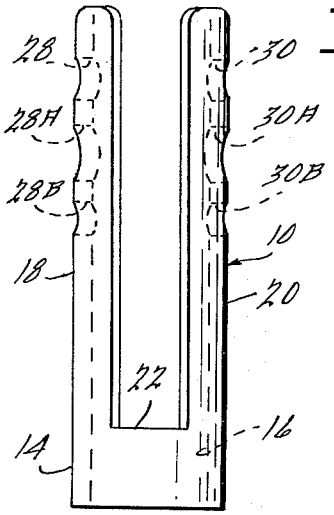
Fig. 2.
Fig. 4.
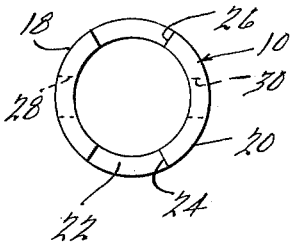
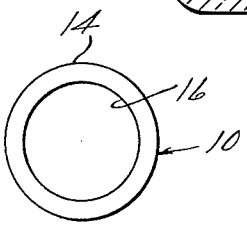
Fig. 5.
Fig. 6.

Fig. 7.
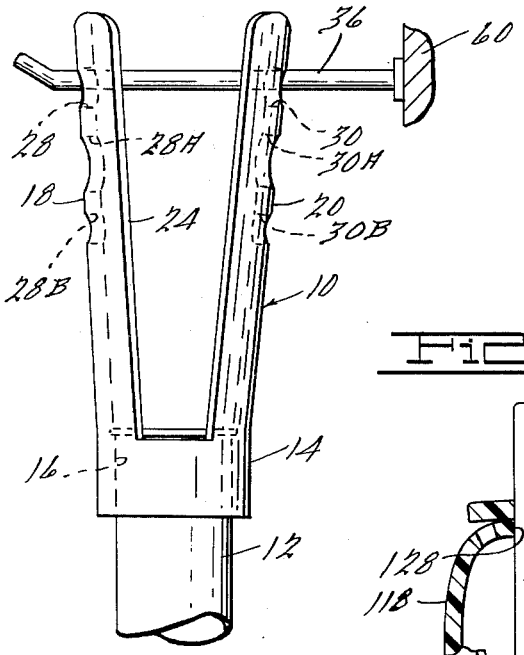
Fig. 9.
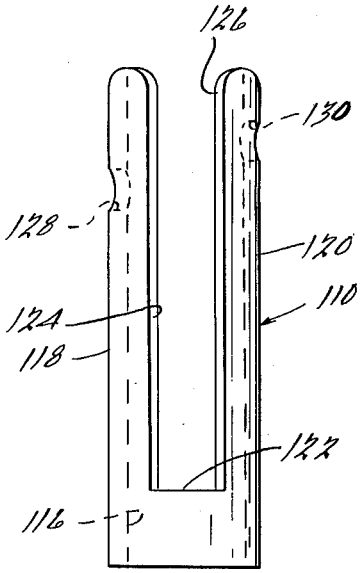
Fig. 10.
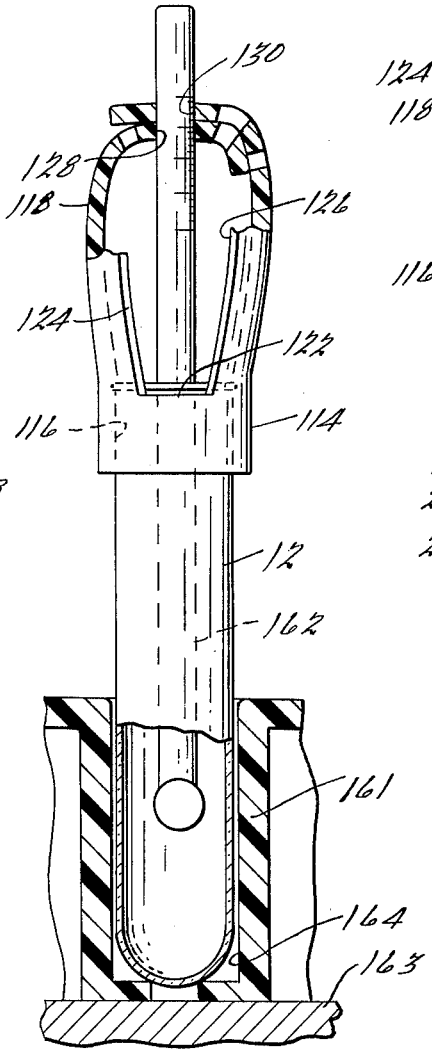
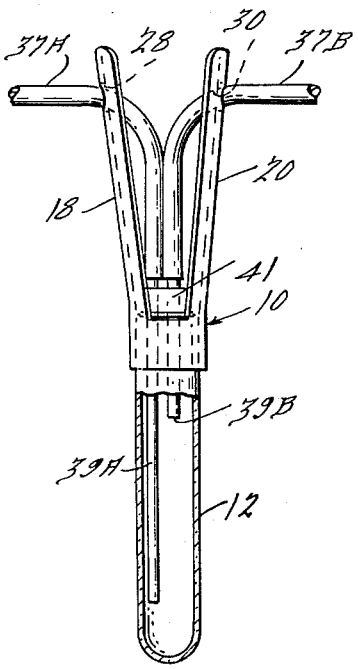
Fig. 8.
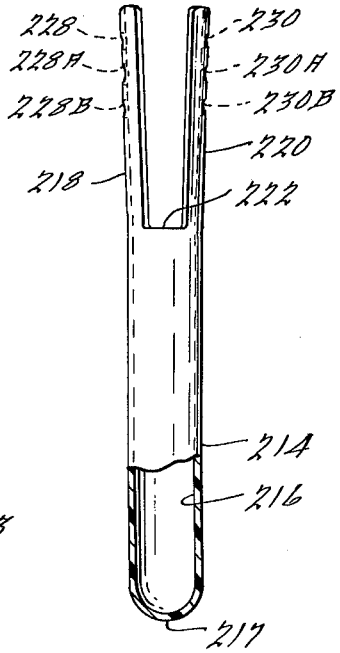
Fig. 11.

COUPLING MEANS FOR TEST TUBES AND THE LIKE

BRIEF SUMMARY OF THE INVENTION

This invention relates to coupling means and, more particularly, to an improved coupling means particularly adapted to use in coupling test tubes to other objects or devices for various purposes, as for example, support purposes, While this invention is particularly intended for use with test tubes of the type that are of generally tubular configuration and closed at one end, it will be understood that the present invention is also applicable to other uses.

As is well known in the art, test tubes are usually made in the form of a substantially cylindrical tube which is closed at one end, the opposite end of the test tube often being provided with an integral, circumferential, radially extending flange portion. The present invention is particularly intended for use in coupling test tubes to other objects or devices. By way of example, a coupling means embodying the present invention may be utilized to couple a test tube to the stem of a funnel, which stem may or may not project into the test tube. The funnel, in turn, may support the test tube in a conventional vacuum flask or other vessel for filtering or other purposes. By way of further example, the coupling means embodying the present invention may be utilized to couple a test tube to either a horizontal or a vertical support rod in a manner such that the contents of the test tube are readily visible at all times. In addition, coupling means embodying the present invention may be utilized to support a test tube in an inverted position for drying purposes or to suspend a thermometer or other object in a test tube. Moreover, the coupling means may be utilized to support a test tube for gravity filtering purposes; to support a test tube for rotational purposes whereby centrifugal forces may be applied to ingredients contained in the test tube; or to support a test tube from a conduit for test purposes, such as a bubble test.

An object of the present invention is to overcome disadvantages in prior devices utilized for supporting test tubes or connecting test tubes to other objects and to provide an improved coupling means incorporating improved means for coupling a test tube to another object or device for a wide variety of purposes.

Another object of the present invention is to provide an improved test tube coupling means which may be easily and quickly mounted on and/or removed from a test tube by the user thereof without requiring special training or tools.

Another object of the invention is to provide an improved test tube coupling means that may, if desired, be formed as an integral part of a test tube.

Another object of the invention is to provide an improved test tube coupling means that is economical to manufacture, durable, efficient and reliable in operation.

Another object of the present invention is to provide an improved coupling means which enables a test tube to be conveniently supported within another container and which also enables another object or device to be supported within the test tube.

Another object of the present invention is to provide an improved test tube coupling means that enables ingredients to be added to or removed from a test tube while the coupling means is mounted thereon, and which enables a test tube to be supported in a manner such that the contents of the test tube are readily visible at all times.

Still another object of the invention is to provide an improved coupling means which may be utilized to support a test tube for rotational purposes whereby centrifugal forces may be applied to ingredients contained in the test tube, and which also may be utilized to support a test tube in an upright position, an inverted position, or in a suspended condition.

The above as well as other objects and advantages of the present invention will become apparent from this specification including the appended claims and the accompanying drawings.

BRIEF DESCRIPTION OF THE DRAWINGS

FIG. 1 is a perspective view of a test tube coupling means embodying the present invention;

FIG. 2 is a side elevational view of the coupling means illustrated in FIG. 1;

FIG. 3 is another side elevational view of the coupling means illustrated in FIG. 1, showing the same rotated 90° about the longitudinal axis thereof from the position illustrated in FIG. 2;

FIG. 4 is a top plan view of the coupling means illustrated in FIG. 1;

FIG. 5 is a bottom plan view of the coupling means illustrated in FIG. 1;

FIG. 6 is a side elevational view of the coupling means illustrated in FIG. 1, showing the same mounted on a conventional test tube and also illustrating the manner by which the test tube may be coupled to the stem of a funnel and at the same time supported within a conventional vacuum flask;

FIG. 7 is a side elevational view of the coupling means illustrated in FIG. 1, showing the same mounted on a conventional test tube and illustrating the manner by which the test tube may in turn be supported by a horizontal support rod;

FIG. 8 is a side elevational view of the coupling means illustrated in FIG. 1, and illustrating the manner by which a test tube may be suspended from a fluid conduit, as for test purposes;

FIG. 9 is a side elevational view of another embodiment of the invention;

FIG. 10 is a side elevational view of the coupling means illustrated in FIG. 9, showing the same mounted on a conventional test tube and illustrating the manner by which a thermometer may be suspended within the test tube; and FIG. 11 is a side elevational view of still another embodiment of the invention.

DETAILED DESCRIPTION

Referring to the drawings, one embodiment of the present invention is illustrated in FIGS. 1 through 8 thereof, and is comprised of a coupling means, generally designated 10. The coupling means 10 is primarily intended for use in coupling a conventional test tube 12 to other objects or devices for various purposes, although it will be understood that coupling means embodying the present invention are applicable to other uses. As shown in the drawings, the coupling means 10 is comprised of a flexible, resilient, right circular, cylindrical, tubular body portion 14 which defines an internal passageway 16 that is open at each end, the body portion 14 being adapted to be slidably circumposed on a portion of the periphery of a conventional test tube 12, as illustrated in FIGS. 6, 7 and 8. The coupling means 10 also includes a pair of circumferentially spaced, flexible, resilient and integral flange portions 18 and 20 which project longitudinally outwardly from the end 22 of the tubular body portion 14 and which define elongate, open ended, diametrically opposed slots 24 and 26 therebetween. As shown in FIGS. 1, 2 and 4, the flange portions 18 and 20 each define a segment of a right circular cylindrical tube having the same inside diameter and the same outside diameter as the tubular body portion 14, the cylindrical tubular segments being circumferentially spaced and being separated by the opposed slots 24 and 26. In this embodiment of the invention, the flange portions 18 and 20 also define transverse openings 28, 28A, 28B and 30, 30A, 30B, respectively, at a position near, but spaced from, the free ends thereof. The openings 28, 28A, 28B and 30, 30A, 30B are adapted to be aligned in various combinations so as to receive a cooperating member, such as the stem 32 of a conventional funnel 34, as illustrated in FIG. 6; a horizontal support rod 36, as illustrated in FIG. 7; fluid conduits 37A and 37B, as illustrated in FIG. 8; or other object to which it is desired to couple a test tube, such as a thermometer or a vertical support rod. The coupling means 10 may be formed of any desired or conventional flexible, resilient, and preferably elastic material, such as plactic or rubber, having sufficient strength to withstand the forces exerted thereon.

In the embodiment of the invention illustrated in FIGS. 1 through 8, the centers of the openings 28 and 30, 28A and 30A, and 28B and 30B, respectively, are aligned on a horizontal axis, as viewed in FIGS. 2, 3 and 4. The openings 28, 28A and 28B are also preferably of different diameters, as illustrated in FIG. 3, and the diameters of the openings 30, 30A and 30B preferably correspond with the diameters of the openings 28, 28A and 28B, respectively.

FIG. 6 illustrates the manner by which the coupling means 10 may be mounted on and utilized to support a conventional test tube 12 within a conventional vacuum flask 38 having a diverging body portion 40 closed by a bottom wall 42, and a substantially cylindrical neck portion 44 formed integrally with the body portion 40. The vacuum flask 38 thus defines an internal chamber 46, and the vacuum flask is also provided with an integral tubular inlet 48 which may be connected to a suitable source of vacuum (not shown) by a flexible tube 50 whereby vaccum may be applied to the chamber 46. As previously mentioned, the coupling means 10 may be utilized to couple the test tube 12 to the stem 32 of a conventional funnel 34 whereby the test tube 12 is supported within the vacuum flask 38. As shown in FIG. 6, for such use, the stem 32 of the funnel is initially passed through a passageway 52 defined by a conventional stopper 54 after which the stem 32 of the funnel may be passed, for example, through the aligned openings 28 and 30 defined by the flange portions 18 and 20 of the coupling means 10 so as to couple the test tube 12 to the stem 32 of the funnel. The test tube 12 with the coupling means 10 mounted thereon is then inserted into the flask and the stopper 54 inserted into the neck portion 44 of the flask 38 whereby the test tube is supported within the flask. With such a construction, various liquids or other ingredients may be vacuum filtered, as for test purposes, directly into the test tube 12 through a suitable filter 56 supported within the diverging portion 58 of the funnel 34 without contaminating the vacuum flask 38. Consequently, it is not necessary to clean the relatively large and complex vacuum flask after each filtering operation, it only being necessary to clean the test tube 12 if it is desired to reuse the same.

It will be noted that because of the inherent difference in the radii of curvature of the flange portions 18 and 20 of the coupling means 10 provided when the stem 32 of the funnel 34 is inserted through the openings 28 and 30 defined by the flange portions 18 and 20 of the coupling means 10, the flexible, resilient, segmental flange portions 18 and 20 tend to grip the stem 32 of the funnel tightly and also hold the rest tube 12 in tilted relationship with respect to the stem 32 of the funnel. Such tilted relationship may be utilized advantageously in that liquid or other ingredients flowing out of the stem 32 and into the test tube flow smoothly down the inner wall of the test tube and does not tend to fall and splash into the bottom of the test tube.

FIG. 7 illustrates the manner by which the coupling means 10 may be mounted on a test tube 12 and utilized to support the test tube on a horizontal support rod 36 by passing the support rod 36 through, for example, the aligned openings 28 and 30 defined by the flange portions 18 and 20 of the coupling means 10, it being understood that the aligned openings 28A and 30A or the openings 28B and 30B may be utilized if desired. The support rod 36, in turn, may be secured to a fixed support 60 as schematically illustrated in FIG. 7. Such a construction renders the contents of the test tube visible at all times and also enables ingredients to be easily added to or removed from the test tube through the slots 24 and 26 defined between the flange portions 18 and 20 of the coupling means 10. It will also be appreciated that a suitable rod, manually or otherwise supported, may be inserted through the aligned openings, such as 28 and 30, of a coupling means mounted on a test tube whereby the test tube may be swung or otherwise rotated so that centrifugal forces may be applied to ingredients contained in the test tube.

FIG. 8 illustrates the manner by which the coupling means 10 may be utilized to suspend a test tube 12 from fluid conduits 37A and 37B, as for example, for bubble test purposes. For such use, the conduit 37A may be passed through the opening 28 defined by the flange portion 18, and the conduit 37B passed through the opening 30 defined by the flange portion 20, as illustrated in FIG. 8. The free ends of the conduits 37A and 37B are then connected to tubes 39A and 39B, the tubes 39A and 39B, in turn, passing through a conventional stopper 41 inserted into the open end of the test tube 12 whereby the test tube is supported by the coupling means 10, and the coupling means 10 is supported by the conduits 37A and 37B. With such an arrangement, the flexed and resilient segmental flange portions 18 and 20 also apply forces to the conduits 37A and 37B tending to hold the stopper 41 tightly in the test tube 12.

Another embodiment of the invention is illustrated in FIGS. 9 and 10 of the drawings, and is comprised of a coupling means, generally designated 110, which is also intended for use in coupling a conventional test tube 12 to other objects or devices for various purposes, although it will be understood that the coupling means 110 embodying the present invention is also applicable to other uses. As shown in FIGS. 9 and 10, the coupling means 110 is comprised of a flexible, resilient, tubular body portion 114 which defines an internal passageway 116 that is open at each end, the body portion 114 being adapted to be slidably circumposed on a portion of the periphery of a conventional test tube 12, as illustrated in FIG. 6. The coupling means 110 also includes a pair of circumferentially spaced, flexible, resilient and integral flange portions 118 and 120 which project longitudinally outwardly from the end 122 of the tubular body portion 114 and which define elongate, open ended, diametrically opposed slots 124 and 126 therebetween. Each of the flange portions 118 and 120 also defines a segment of a right circular cylindrical tube having the same inside diameter and the same outside diameter as the tubular body portion 114, the cylindrical tubular segments being circumferentially spaced and being separated by the opposed slots 124 and 126. In this embodiment of the invention, the flange portions 118 and 120 also define transverse openings 128 and 130, respectively, adjacent the free ends thereof. In this embodiment of the invention, the centers of the openings 128 and 130 are off set, as illustrated in FIG. 9, and the openings 128 and 130 are thus disposed at unequal distances from the free ends of the flange portions 118 and 120, respectively. The openings 128 and 130 are adapted to receive a cooperating member, such as the stem of a conventional funnel, a thermometer 162, as illustrated in FIG. 10, or other object to which it is desired to couple a test tube. The coupling means 110 is also preferably formed of any desired or conventional flexible, resilient, and preferably elastic material, such as plastic or rubber, having sufficient strength to withstand the forces exerted thereon.

FIG. 10 illustrates the manner by which the coupling means 110 may be mounted on a test tube and utilized to support a thermometer 162 within the test tube with the longitudinal axis of the thermometer disposed in coaxially aligned relationship with the longitudinal axis of the test tube, the test tube 12, in turn, being supported by a conventional support member 161 which may rest on a horizontal surface 163 and which defines a recess 164 adapted to receive the lower end portion of the test tube. In this embodiment of the invention, since the centers of the openings 128 and 130 are off set with respect to each other, when the flange portions 118 and 120 are disposed in overlapping relationship whereby the openings 128 and 130 are disposed in vertical alignment, and when the stem of the thermometer is inserted through the openings 128 and 130, the flexible, resilient flange portions 118 and 120 tend to tightly grip and hold the thermometer vertically, as illustrated in FIG. 10, and in coaxially aligned relationship with respect to the longitudinal axis of the test tube 12. Such aligned relationship may be utilized advantageously to support the thermometer in spaced relationship with respect to the inner walls of the test tube. It will be appreciated that this embodiment of the invention may be utilized to support the stem of a funnel in coaxially aligned relationship with respect to the longitudinal axis of the test tube and in spaced relationship with respect to the inner walls of the test tube if such a relationship is necessary or desirable, or this embodiment of the invention may be utilized to support a test tube in an inverted position, as for drying purposes, by passing a vertically disposed rod through the openings 128 and 130 so that the vertical rod is disposed in coaxially aligned relationship with respect to the longitudinal axis of the test tube and in spaced relationship with respect to the inner walls of the test tube.

It will also be appreciated that the same coaxially aligned relationship between the test tube and the associated supporting or supported member may be obtained by the coupling means 10 illustrated in FIGS. 1 through 8, by utilizing, for example the opening 28 defined by the flange portion 18 in conjunction with the opening 30A defined by the flange portion 20 in the same manner that the opening 128 is utilized in conjunction with the initially non-aligned or off set opening 130.

Another embodiment of the present invention is illustrated in FIG. 11, and is comprised of a combined test tube and coupling means, generally designated 210. As shown in FIG. 11, the combined test tube and coupling means includes a flexible, resilient, elongate tubular body portion 214 which defines an internal chamber 216 that is closed at the lower end 217 and open at the upper end 222, the body portion 214 thus being adapted to function in the manner of a conventional test tube. The combined test tube and coupling means 210 also includes a pair of circumferentially spaced, flexible, resilient and integral flange portions 218 and 220 which project longitudinally outwardly from the end 222 of the tubular body portion 214 and which define elongate, open ended, diametrically opposed slots, similar to the slots 24 and 26, therebetween. The flange portions have the same tubular segmental configuration as the flange portions previously described. In this embodiment of the invention, the flange portions 218 and 220 also define openings 228, 228A, 228B and 230, 230A, 230B, respectively, at a position near, but spaced from, the free ends thereof. Such openings are similar to the openings defined by the flange portions 18 and 20 and are adapted to receive a cooperating member, such as the stem of a conventional funnel, a support rod, fluid conduits, or other object to which it is desired to couple a test tube, such as a thermometer, in the manner previously described. The combined test tube and coupling means 210 may also be formed of any desired or conventional flexible, resilient, and preferably elastic material, such as plastic or rubber, having sufficient strength to withstand the forces exerted thereon, the material preferably being inert with respect to the ingredients that may be placed in the chamber 216.

It will be readily apparent that this embodiment of the invention will function in the same manner and may be utilized to obtain the same results as the embodiments of the invention previously described and illustrated in FIGS. 1 through 10.

While preferred embodiments of the invention have been illustrated and described, it will be understood that various changes and modifications may be made without departing from the spirit of the invention.

What is claimed is:

1. A coupling means comprising a tubular body portion open at at least one end, said coupling means also including a pair of equally circumferentially spaced, flexible, resilient, opposed flange portions projecting longitudinally outwardly from said one end of said tubular body portion, said flange portions each defining an opening disposed at a position near, but spaced from, the free end thereof, each of said openings being located along a plane that includes the longitudinal axis of said tubular body portion whereby the openings in said flange portions are located generally across from each other.

2. A coupling means as set forth in claim 1 wherein said flange portions are formed integrally with said tubular body portion.

3. A coupling means as set forth in claim 1 wherein the openings defined by said flange portions are also disposed in a plane normal to the longitudinal axis of said tubular body portion whereby the centers of the openings are in straight line relationship with respect to each other.

4. A coupling means as set forth in claim 1 wherein said flange portions are of equal length and wherein the openings defined by said flange portions are disposed at unequal distances with respect to the free ends of said flange portions.

5. A coupling means as set forth in claim 1 wherein said flange portions each define a plurality of openings and wherein corresponding openings in each of said flange portions are located generally across from each other.

6. A coupling means for test tubes and the like, said coupling means comprising a right circular cylindrical tubular portion open at each end and adapted to be slidably circumposed on a portion of the periphery of a test tube, said coupling means also including a pair of equally circumferentially spaced, resilient, opposed flange portions each defining a segment of a right circular cylindrical tube and projecting longitudinally outwardly from one end of said tubular body portion, said flange portions each defining a transverse opening at a position near, but spaced from, the free end thereof, each of said openings being located along a plane that includes the longitudinal axis of said tubular body portion whereby the openings in said flange portions are located generally across from each other.

7. A coupling means as set forth in claim 6 wherein said flange portions are formed integrally with said tubular body portion and have the same inside diameter and the same outside diameter as said body portion.

8. A coupling means as set forth in claim 7 wherein the transverse openings defined by said flange portions are also disposed in a plane normal to the longitudinal axis of said tubular body portion whereby the centers of the openings are in straight line relationship with respect to each other.

9. A coupling means as set forth in claim 8 wherein said flange portions are of equal length and wherein the openings defined by said flange portions are disposed at unequal distances with respect to the free ends of said flange portions.

10. A coupling means as set forth in claim 9 wherein said flange portions each define a plurality of circular openings of different diameters and wherein corresponding openings of the same diameters are located generally across from each other.

11. In combination with a tubular test tube closed at one end, a coupling means having a tubular body portion open at each end thereof and adapted to be slidably circumposed on a portion of the periphery of said test tube, said coupling means also including a pair of equally circumferentially spaced, flexible, resilient, opposed flange portions projecting longitudinally outwardly from one end of said body portion, each of said flange portions defining an opening adjacent the free end thereof, each of said openings being located along a plane that includes the longitudinal axis of said tubular body portion whereby the openings in said flange portions are located generally across from each other.

12. The combination as set forth in claim 11 wherein said flange portions are of equal length and formed integrally with said body portion and wherein the openings defined by said flange portions are disposed in a plane normal to the longitudinal axis of said tubular body portion whereby the centers of the openings are in straight line relationship with respect to each other.

13. The combination as set forth in claim 11 wherein the openings defined by said flange portions are disposed at unequal distances with respect to the free ends of said flange portions.

14. A unitary combined test tube and coupling means formed of flexible, resilient material and comprising a tubular body portion open at one end and closed at the opposite end thereof, said unitary combined test tube and coupling means also including a pair of equally circumferentially spaced, opposed flange portions formed integrally with said body portion and projecting longitudinally outwardly from said one end of said tubular body portion, said flange portions each defining a transverse opening disposed at a position near, but spaced from, the free end thereof, each of said openings being located along a plane that includes the longitudinal axis of said tubular body portion whereby the openings in said flange portions are located generally across from each other.

15. A unitary combined test tube and coupling means as set forth in claim 14 wherein said flange portions each define a segment of a right circular cylindrical tube, and wherein the transverse openings defined by said flange portions are also disposed in a plane normal to the longitudinal axis of said tubular body portion whereby the centers of the openings are in straight line relationship with respect to each other.

16. A combined test tube and coupling means as set forth in claim 14 wherein said flange portions are of equal length and the transverse openings defined by said flange portions are disposed at unequal distances with respect to the free ends of said flange portions.

17. A combined test tube and coupling means as set forth in claim 14 wherein said flange portions each define a plurality of openings and wherein corresponding openings in each of said flange portions are located generally across from each other.

18. A combined test tube and coupling means as set forth in claim 17 wherein the openings defined by each flange portion are of different diameters.

* * * * *